US007714261B2

(12) United States Patent
Bnayahu et al.

(10) Patent No.: US 7,714,261 B2
(45) Date of Patent: May 11, 2010

(54) SYSTEM AND METHOD FOR PROTECTION OF AIRCRAFT BASED ON CORRELATING SUSPECTED MISSILE TRACKS TO DERIVE A CONFIRM MISSILE TRACK

(75) Inventors: Yair Bnayahu, Camon (IL); Yaakov Lichter, Yuvalim (IL); Egon Gersch, Kiriat Bialik (IL)

(73) Assignee: Rafael Advanced Defense Systems Ltd., Haifa (IL)

( * ) Notice: Subject to any disclaimer, the term of this patent is extended or adjusted under 35 U.S.C. 154(b) by 0 days.

(21) Appl. No.: 11/402,971

(22) Filed: Apr. 13, 2006

(65) Prior Publication Data

US 2007/0052806 A1 Mar. 8, 2007

(30) Foreign Application Priority Data

Apr. 21, 2005 (IL) ..... 168212

(51) Int. Cl.
*G02B 7/04* (2006.01)
*G02B 27/40* (2006.01)
*G02B 27/64* (2006.01)

(52) U.S. Cl. ..... 250/203.6; 250/203.7

(58) Field of Classification Search ... 250/203.1–203.7; 89/37.01, 37.02, 1.11; 701/300–301; 244/1 TD
See application file for complete search history.

(56) References Cited

U.S. PATENT DOCUMENTS 5,347,391 A 9/1994 Cook
5,534,697 A 7/1996 Creekmore
6,404,380 B2 * 6/2002 Poore, Jr. ..... 342/96
6,410,897 B1 6/2002 O'Neill
6,738,012 B1 * 5/2004 Kirkpatrick ..... 342/67
7,205,520 B1 * 4/2007 Busse et al. ..... 250/203.6
7,230,221 B2 * 6/2007 Busse et al. ..... 250/203.6

(Continued)

FOREIGN PATENT DOCUMENTS

EP 1416312 5/2004

(Continued)

OTHER PUBLICATIONS

Article: "Airliner Missile Defense: At What Cost?" Aviation Today—Apr. 11, 2005; Charlotte Adams (http:/www.aviationtoday.com/cgi/av/show_mag.cgi?pub=av&mon=0504&file=airline.

(Continued)

*Primary Examiner*—Thanh X Luu
*Assistant Examiner*—Francis M Legasse, Jr.
(74) *Attorney, Agent, or Firm*—Mark M. Friedman

(57) ABSTRACT

A system and method for protection of aircraft against surface-to-air missiles deploys sensors to provide coverage around an airport The use of a fixed (or slow moving) set of sensors around the airport allows detection of missile threats to all aircraft using the airport without requiring each individual aircraft to be provided with a threat detection system. Information about a detected threat is then typically transmitted in real time directly to the aircraft under threat to allow timely deployment of aircraft-based countermeasures. The detection system and method preferably employ spaced-apart sensors with overlapping fields of view to provide enhanced tracking through triangulation and reduced false alarm rates by redundancy of information. Airborne systems with overlapping coverage may be also used.

34 Claims, 5 Drawing Sheets

U.S. PATENT DOCUMENTS

| | | | | |
|---|---|---|---|---|
| 2005/0001755 | A1* | 1/2005 | Steadman et al. | 342/14 |
| 2005/0150371 | A1* | 7/2005 | Rickard | 89/1.11 |

FOREIGN PATENT DOCUMENTS

| | | |
|---|---|---|
| EP | 1455199 | 9/2004 |
| WO | WO2004/008403 | 1/2004 |
| WO | WO2004109251 | 12/2004 |

OTHER PUBLICATIONS

Thales; IRST—Infrared Search & Track; (http://www.thales-naval.com/activities/radar-sys/infrared-search-track/products/body).

Article: "Executive Overview: Jane's Radar and Electronic Warfare Systems" Mar. 23, 2005; Martin Streetly; (http://www.janes.com/aerospace/civil/news/jrew/jrew050323_1_n.shtml) Printed Apr. 11, 2005.

Article: "Fact Sheet: US Department of Homeland Security Programs Countering Missile threats to Commercial Aircraft" ; US Dept. of Homeland Security (http://fas.org/asmp/campaigns/MANPADS/DHSfactsheet25aug04.htm) Printed Apr. 11, 2005.

Article: AOC Position Statement; "Missile Defense Systems for the American Commercial Airline Fleet"(revised Oct. 30, 2003); www.CROWS.org.

* cited by examiner

SYSTEM AND METHOD FOR PROTECTION OF AIRCRAFT BASED ON CORRELATING SUSPECTED MISSILE TRACKS TO DERIVE A CONFIRM MISSILE TRACK

FIELD AND BACKGROUND OF THE INVENTION

The present invention relates to missile detection systems and, in particular, it concerns a missile detection system and corresponding method for identifying missile threats to aircraft.

Over recent years, the growth of terrorist organizations has given rise to great concern for the safety of civilian aircraft from attack by various surface-to-air missiles. Various countermeasure systems for protecting aircraft from such missiles have become standard features of most military aircraft. However, the economics of commercial civilian airliners together with stringent safety requirements prohibit direct adoption of military countermeasure systems on commercial aircraft. Even for military aircraft, the relatively high false alarm rates are considered problematic.

It is generally believed that the threat from terrorist organizations is at this time primarily from relatively old heat-seeking or radar navigated missiles of types which can be lured away from their intended target by simple low cost countermeasures such as decoy flares or radar chaff. Other countermeasures commonly employed include direct infrared countermeasures (DIRCM). The more expensive aspect of protection systems is typically the detection system which is required to detect an incoming missile sufficiently early to allow timely deployment of the countermeasures. Many attempts have been made to produce a relatively low cost detection system, typically based on passive optical sensors in the IR wavelength range which detect the thermal signature of a missile. Examples of systems intended for this or similar purposes include EP 1416312 A1, U.S. Pat. No. 5,347,391, U.S. Pat. No. 5,534,697 and U.S. Pat. No. 6,410,897 B1. For the most part, the commercially available systems seem to be plagued by problems of insufficient sensitivity and/or high false alarm rates (FAR). False alarms pose a particular problem in this field, since they are likely to result in unnecessary deployment of flares or chaff over populated areas immediately around airports, causing concern and posing a possible safety hazard for the local population.

In view of these problems, and the anticipated costs of more elaborate systems which address these problems, an article published Mar. 23, 2005, under the title "Executive Overview: Jane's Radar and Electronic Warfare Systems" (which can be viewed at http://www.janes.com/aerospace/civil/news/irew/jrew050323_1_n.shtml) sums up the prospects for implementation of anti-missile countermeasure systems on civilian aircraft as follows:

> "While there can be no doubt that portable SAMs [surface-to-air missiles] represent a very real threat to civilian aircraft and that the cited solutions would all be more or less effective counters, JREW [Jane's Radar and Electronic Warfare] believes that the current drive towards wide-scale use of such equipment may falter in the face of cost and infrastructure considerations. Unless governments are willing to invest large amounts of money in such programmes, JREW believes that the airline industry itself will be unable (and in some cases, unwilling) to fund the widescale introduction of anti-missile measures."

There is therefore a need for a cost effective and reliable system and method for detecting missile threats to commercial aircraft so as to allow timely deployment of anti-missile countermeasures.

SUMMARY OF THE INVENTION

The present invention is a system and method for detecting missile threats to commercial aircraft.

According to the teachings of the present invention there is provided, a system for identifying missile threats against aircraft within a region of interest and activating a countermeasure system, the system comprising: (a) a plurality of spaced-apart optical imaging arrangements deployed relative to the region of interest such that at least part of the airspace over substantially the entirety of the region of interest falls within the field of view of at least two of the optical imaging arrangements; and (b) a processing system including at least one processor, the processing system being associated with the plurality of optical imaging arrangements and configured to: (i) process outputs from each of the optical imaging arrangements to derive suspected missile tracks; (ii) correlate suspected missile tracks derived from separate ones of the optical imaging arrangements to derive confirmed missile tracks; and (iii) output an actuation command for actuating a countermeasure system.

There is also provided according to the teachings of the present invention a method for identifying missile threats against aircraft within a region of interest and activating a countermeasure system, the system comprising: (a) deploying a plurality of spaced-apart optical imaging arrangements deployed relative to the region of interest such that at least part of the airspace over substantially the entirety of the region of interest falls within the field of view of at least two of the optical imaging arrangements; (b) monitoring outputs from each of the optical imaging arrangements to derive suspected missile tracks; (c) correlating suspected missile tracks derived from separate ones of the optical imaging arrangements to derive confirmed missile tracks; and (d) outputting an actuation command on derivation of a confirmed missile track for actuating a countermeasure system.

According to a further feature of the present invention, a current position is determined in three dimensions of a missile corresponding to each confirmed missile track.

According to a further feature of the present invention, a velocity vector is determined in three dimensions of a missile corresponding to each confirmed missile track.

According to a further feature of the present invention, an acceleration is determined of a missile corresponding to each confirmed missile track.

According to a further feature of the present invention, (a) information is received indicative of at least a current position of each aircraft within the airspace of the region of interest; and (b) it is determined towards which of the aircraft a missile corresponding to each confirmed missile track is navigating.

According to a further feature of the present invention, the actuation command is transmitted to the aircraft towards which the missile is navigating for activation of an aircraft-based countermeasure system.

According to a further feature of the present invention, a geographical launch location is estimated from which each of the confirmed missile tracks originated.

According to a further feature of the present invention, at least one of the optical imaging arrangements is implemented as a panoramic arrangement including a plurality of optical imaging arrays deployed to provide an effective field of view substantially spanning 360 degrees.

According to a further feature of the present invention, the region of interest is a predefined geographical region.

According to a further feature of the present invention: (a) additional suspected missile track data is relayed from a missile detection system mounted on at least one aircraft currently airborne near the predefined geographical region; and (b) the additional suspected missile track data is correlated with at least one of: suspected missile tracks derived from one of the optical imaging arrangements; and confirmed missile tracks derived by the processing system.

According to a further feature of the present invention, the plurality of optical imaging arrangements are deployed in substantially stationary locations relative to the predefined geographical region.

According to a further feature of the present invention, two of the plurality of optical imaging arrangements are spaced apart by at least about 1 kilometer.

According to a further feature of the present invention, at least one of the optical imaging arrangements is deployed on a floating platform.

According to a further feature of the present invention, the predefined geographic region encompasses a circular area of radius at least 15 kilometers around an airport.

According to a further feature of the present invention, the predefined geographic region further encompasses at least one converging strip terminating at a distance of at least 40 kilometers from the airport.

According to an alternative implementation of the present invention, the plurality of spaced-apart optical imaging arrangements are mounted on a plurality of aircraft, and wherein the region of interest is a region of airspace surrounding the plurality of aircraft.

According to a further feature of this implementation of the present invention, the plurality of spaced-apart optical imaging arrangements are mounted on a subset of a group of aircraft flying together.

BRIEF DESCRIPTION OF THE DRAWINGS

The invention is herein described, by way of example only, with reference to the accompanying drawings, wherein.

DESCRIPTION OF THE PREFERRED EMBODIMENTS

The present invention is a system and method for identifying missile threats against aircraft and activating a countermeasure system.

The principles and operation of systems and methods according to the present invention may be better understood with reference to the drawings and the accompanying description.

By way of introduction, the present invention is based upon two primary points of novelty, each of which is believed to be patentable in its own right, but which are most preferably employed synergistically to provide profound advantages over existing missile detection systems. According to a first aspect, the present invention provides missile detection by deploying sensors to provide coverage for a threat zone (for example around an airport) defined by the assumed range/altitude limitations of surface-to-air missiles, preferably in combination with specific information about flight paths around an airport and/or an assumed geographical area from which the threat will originate. The use of a fixed (or slow moving) set of sensors around the airport allows detection of missile threats to all aircraft using the airport without requiring each individual aircraft to be provided with a threat detection system. This typically reduces the number of sensor systems which must be installed by as much as one or two orders of magnitude (e.g., in the US, roughly 400 airports rather than over 6000 aircraft), thereby rendering it feasible to use more sophisticated and reliable sensor technology. Information about a detected threat is then typically transmitted in real time directly to the aircraft under threat to allow timely deployment of aircraft-based countermeasures. Alternatively, a central countermeasures system such as a ground-based direct IR countermeasures (DIRCM) system may be used to neutralize the threat.

According to a second aspect of the present invention, the detection system and method employ a plurality of spaced-apart sensors with overlapping fields of view to provide enhanced tracking through triangulation and reduced false alarm rates by redundancy of information. This principle is applicable even to airborne systems, so long as at least two sets of spaced-apart sensors give coverage of each part of the region to be monitored at any time.

Figure 1:
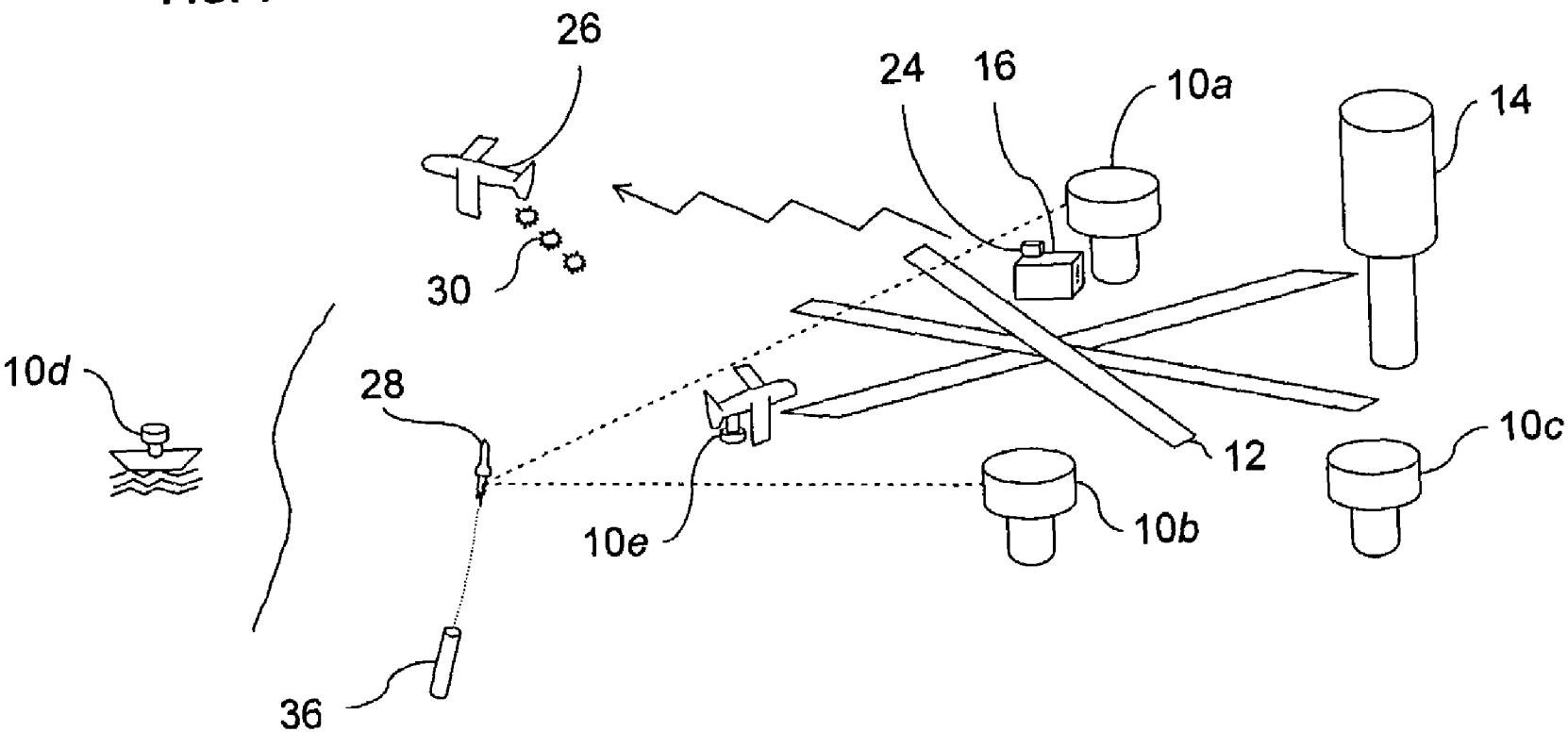
FIG. 1 is a schematic illustration of a system for identifying missile threats against aircraft in a region of interest (in this case, around an airport), the system being constructed and operative according to the teachings of the present invention.

Referring now to the drawings, FIG. 1 shows schematically the components of a system, constructed and operative according to the teachings of the present invention, for identifying missile threats against aircraft within a region or interest, in this case a predefined geographical region around an airport, and activating a countermeasure system. Generally speaking, the system includes a plurality of spaced-apart optical imaging arrangements 10*a*, 10*b*, 10*c* deployed relative to an airport (represented by a set of runways 12 and a control tower 14) such that substantially the entirety of the airspace over the predefined geographical region falls within the field of view of at least two of optical imaging arrangements 10*a*, 10*b*, 10*c*. The system also includes a processing system 16 associated with optical imaging arrangements 10*a*, 10*b*, 10*c*. Processing system 16 is configured to perform some, or all, of the operations illustrated in FIG. 2, thereby also implementing the corresponding method of the present invention, as follows.

Firstly, processing system 16 processes outputs from each of the optical imaging arrangements to derive suspected missile tracks detected by each (step 18). Then, the processing system correlates the suspected missile tracks derived from separate optical imaging arrangements to derive confirmed missile tracks where corresponding tracks were detected by more than one imaging arrangement and satisfy other given missile track validity conditions (step 20). An actuation command is subsequently output for actuating a countermeasure system (step 22). (The remaining steps of FIG. 2 not mentioned above will be discussed below.)

At this point, it will already be apparent that the system and method of the present invention provide profound advantages over prior art systems. Specifically, the use of an airport-centered detection system provides threat detection for all aircraft using the airport without requiring each aircraft to have a separate missile detection system. Furthermore, the use of multiple spaced-apart sensors with overlapping fields of view provides for correlation of suspected missile tracks, thereby substantially eliminating the problem of false alarms. The use of spaced-apart sensors also provides triangulation data for highly precise location and tracking of the advancing missile, thereby providing numerous additional features which will be described in more detail below.

Before addressing the features of the present invention in more detail, it will be useful to define certain terminology as used herein in the description and claims. Firstly, reference is made herein in the description and claims to "airspace over a geographical region". In this context, airspace is taken to refer to all altitudes which are above ground-clutter resulting from buildings, vehicles or vegetation, and undulations of the geographical relief, and which are low enough to be relevant to aircraft under threat from the assumed threat. In numerical terms, this can typically be assumed to relate to all altitudes from 100 meters, or even 50 meters, upwards, up to the range of heights used by aircraft landing or taking off from the airport at the corresponding range from the airport. It is not typically necessary to monitor the airspace up to the theoretical ceiling of the threat (for example 5000 meters) directly above the airport, since no aircraft will typically be at intermediate altitudes between 1000 and 5000 meters in the immediate vicinity of the airport.

In a further issue of terminology, when reference is made to distances from the airport, these can be assumed to be from an arbitrary central location within the airport. Where a more precise definition is required, a geometrical centroid of the various runways may be used.

Reference is made herein to a "predefined geographical region" around the airport. Most preferably, this geographical region approximates to a definition on the ground of the set of locations from which a surface-to-air missile could be launched and could successfully hit an aircraft using the airport according to normal flight paths for take off and landing procedures. This evaluation necessarily requires certain assumptions about the nature and capabilities of the anticipated threat, and such assumptions may need to be updated according to the best available intelligence information. In practice, however, all missile countermeasure systems are to some extent based on assumptions regarding the nature of the threat, and it is feasible to use estimates with some margin of safety as the basis for reasonable precautions.

Figure 3:
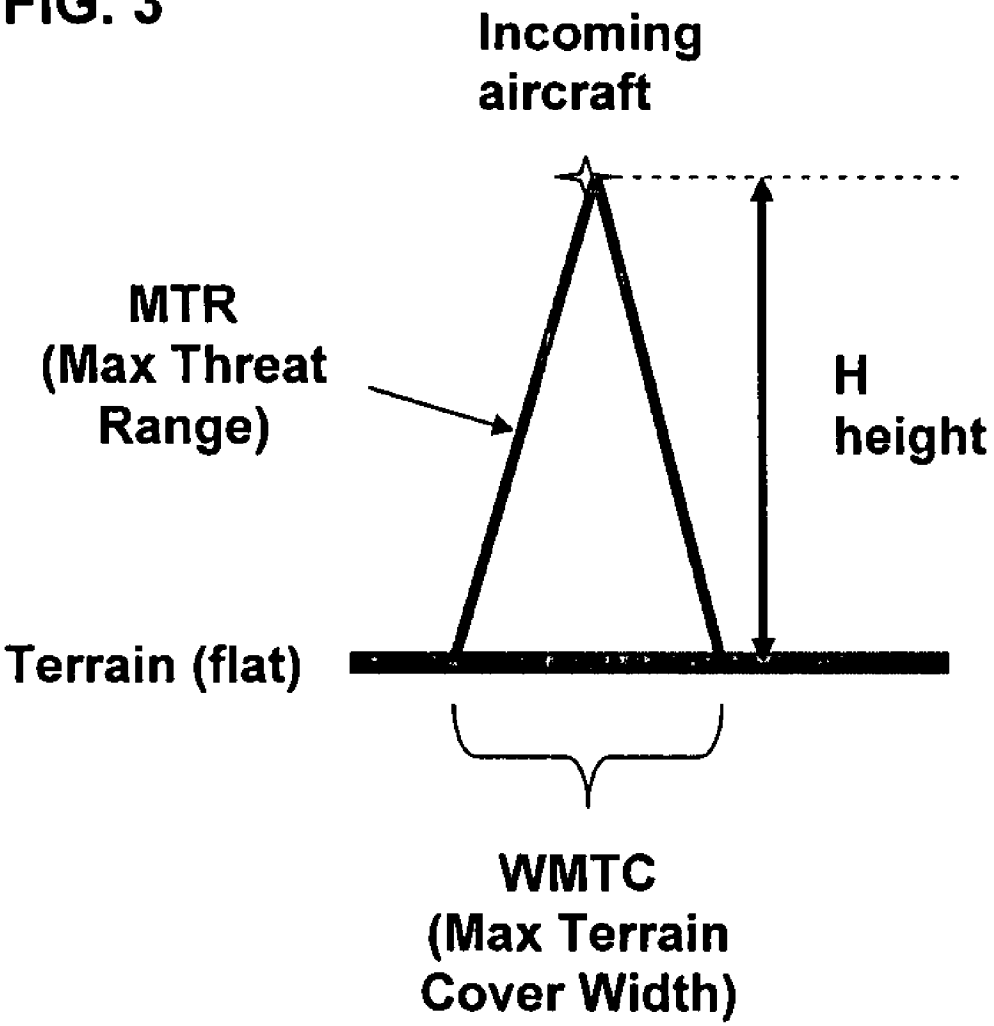
FIG. 3 is a schematic illustration of calculation of a geographical threat region as a function of flight-path height as the flight path ascends from or descends to an airport.

In the present case, as illustrated schematically in FIG. 3, assumptions as to the maximum range/ascent of the missile threat leads directly to a corresponding calculation of the geographical area from which an aircraft at a given altitude can be effectively targeted. Thus, when the aircraft is at minimal altitude just before or after landing or take-off, an offensive missile could be launched from the extent of its horizontal range, for example, up to about 10 kilometers from the airport. Once an aircraft reaches altitudes above about 5000 meters, it is typically out of range of most ground-launched missiles. In between these altitudes, the width of the region from which launch of the threat could be effective varies as a function of the altitude.

It should also be noted that the steepness (gradient) of descent and ascent to and from an airport are generally quite standard, typically at least about 5%, i.e., 1:20. The width of the threat area under an aircraft flying into or out of an airport can therefore be represented in rough terms as a function of distance of the aircraft from the airport. One non-limiting example, for a given set of assumptions about the offensive missile properties, would be roughly as follows:

| Range from Airport (km) | Height (m) | WMTC (m) |
|---|---|---|
| 80 | 5,000 | 0 |
| 40 | 2,500 | 10,000 |
| 20 | 1,250 | 15,000 |
| 5 | ~300 | 18,750 |
| "0" | "0" | 20,000 |

Figure 4:
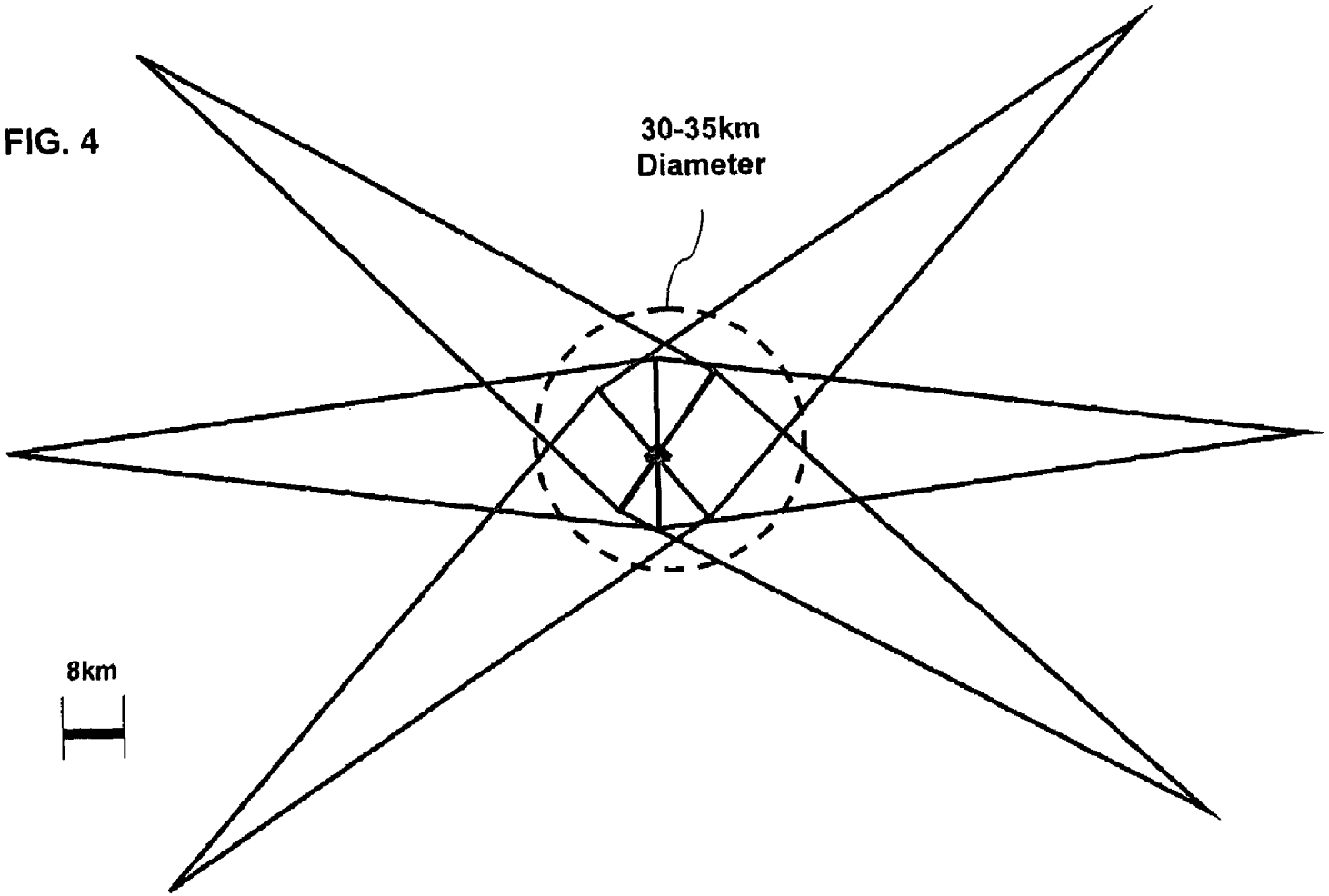
FIG. 4 is a schematic plan view of a typical geographical threat region around an airport.

Given that the flight paths into and out of airports are also generally standard, the resulting effective threat launch region typically assumes an appearance similar to that illustrated in FIG. 4. Specifically, low altitude targets in the vicinity of the airport itself are vulnerable from all directions, resulting in a substantially circular region centered around the airport. A threat radius of around 15 kilometers or slightly greater is typically enough to ensure that all practical threats are included in the monitored area. Outside this central circle extend a number of converging strips (i.e., tapering strips or narrow elongated isosceles triangles) which are dictated by the predefined flight paths and their associated ascent/descent altitude profiles as described above. These strips usually extend at least 40 kilometers, and typically reach extinction (i.e., reach altitude sufficient to be out of range of the assumed threats) somewhere in the range of 60-100 kilometers from the airport, and most typically around 80 kilometers therefrom. As stated previously, these figures are an approximate indication of the required cover based on a specific set of assumptions which may need to be revised (typically upwards) as the nature of the threat assessment changes.

Parenthetically, it will be clear that the threat region evaluation must also take into account additional flight paths such as temporary "waiting" paths used by aircraft which are waiting for a runway to be available for landing.

It should also be noted that the present invention may be applied to other "threat regions" relevant to civilian and military aircraft, for example where a defined locality is suspected as a launch region for anti-aircraft fire. This may occur where military aircraft fly over hostile territory.

Turning now to the features of the system as shown in FIG. 1 in more detail, processing system 16 may be any type of processing system suitable for performing the recited functions. Typically, processing system 16 is implemented as a computer based on one or more processors, and may be located in a single location or subdivided into a number of physically separate processing subsystems. Possible implementations include general purpose computer hardware executing an appropriate software product under any suitable operating system. Alternatively, dedicated hardware, or hardware/software combinations known as firmware, may be used. In either case, the various tasks described herein are typically implemented using a plurality of modules which may be implemented using the same processor(s) or separate processors using any suitable arrangement for allocation of processing resources, and may optionally have common subcomponents used by multiple modules, as will be clear to one ordinarily skilled in the art from the description of the function of the modules.

The optical imaging arrangements 10*a*, 10*b*, 10*c* are preferably implemented as infrared imaging arrangements including one or more sensor array sensitive to infrared radiation for detecting thermal emissions of missiles. Preferably, at least one of the optical imaging arrangements is implemented as a panoramic arrangement including a plurality of optical imaging arrays deployed to provide an effective field of view substantially spanning 360 degrees. In this context, the "effective field of view" is the total field of view monitored by the optical imaging arrangement, either continuously by staring sensors, or intermittently by scanning or switching sensors. Examples of suitable sensors include, but are not limited to, those described in the patent publications mentioned in the prior art section of this document. In a most preferred implementation, an arrangement with a plurality of two-dimensional imaging arrays used together with a field-of-view switching arrangement is used to provide pseudo-continuous (i.e., short re-visit delay) monitoring of a full 360°. An example of such a system is described in co-pending Israel Patent Application No. 167317, which is hereby incorporated by reference.

As mentioned above, it is a particular feature of most preferred implementations of the present invention that the airspace of the threat region is covered by spaced-apart optical imaging arrangements with overlapping coverage areas to provide corroboration of detected tracks and precise position/motion tracking via triangulation. In order to ensure highly precise calculation of position and motion, pairs of the optical imaging arrangements intended to operate together to give coverage of a given area are most preferably spaced apart by at least about 1 kilometer. Where panoramic sensor arrangements are used, and particularly if the sensor arrangements have a radial detection range sufficient to encompass the entire threat region, a single pair of optical imaging arrangements may offer effective coverage. More preferably, in order to ensure sufficient parallax for precise triangulation in all incident directions of a threat, it is preferred to use at least three optical imaging arrangements deployed not in a line.

In many cases, the size of the threat region is too large to be covered by centrally positioned sensors only. In such cases, various combinations of panoramic imaging arrangements and other imaging arrangements with narrower fields of view are deployed to achieve the desired double coverage of the threat region. It will be clear that the relatively narrow strips of the threat region extending under the flight paths can be covered by suitably positioned imaging sensors having a relatively narrow field of view.

In order to ensure continuous coverage for the threat region around an airport, in most cases, the optical imaging arrangements are deployed in substantially stationary locations relative to the airport, typically in fixed locations such as on small towers or pre-existing elevated vantage points such as a hill or tall building. Additionally, or alternatively, optical imaging arrangements may be deployed on land, sea or air vehicles for flexible redeployment according to developing needs (e.g. updated threat assessment or changes in flight paths) or for temporary protection of a site. In the case of a moving vehicle, precise geo-location of the optical imaging arrangement must be known in order to ensure optimal missile position/motion determination. This may be achieved by one, or a combination, of known geo-location techniques including, but not limited to, GPS sensors, inertial navigation systems (INS) and image correlation techniques based on fixed markers or known geographical features appearing within the field of view of the optical imaging arrangement or an associated dedicated sensor.

In some cases, particularly where an airport is located adjacent to a lake or to the coast, one or more optical imaging arrangement may be deployed on a floating platform (illustrated schematically as 10*d* in FIG. 1). In this case, the floating platform is preferably anchored to a fixed location on the sea bed or otherwise retained in a substantially stationary location.

According to a further optionally preferred implementation according to the present invention, the system and method of the present invention may employ data from a missile detection system mounted on one or more aircraft currently airborne near the airport (illustrated schematically as 10*e* in FIG. 1). The word "near" in this context refers to any location where the missile detection system is sufficiently close to detect potential threats in an area at least partially overlapping the predefined threat region. As mentioned above, aircraft mounted systems operating alone tend to suffer from problems of high false alarm rates. These problems are overcome according to the teachings of the present invention since the aircraft mounted system operates in combination with at least one additional optical imaging system remote from the aircraft, thereby providing confirmation (or rejection) of a suspected threat and improved precision regarding the threat's motion parameters.

In most highly preferred implementations, the system is provided with sufficient surface-based imaging arrangements to function fully without input from an aircraft mounted missile detection system, thereby offering protection to all aircraft whether or not they are fitted with a detection system. Even in such a case, the processing system is most preferably still configured to receive additional suspected missile track data relayed from missile detection systems of any aircraft in the area which have such systems. This data is then correlated with either suspected missile tracks derived from one of the optical imaging arrangements or with confirmed missile tracks already derived by the processing system to offer to provide additional levels of detection sensitivity and/or false alarm rejection.

As mentioned earlier, the actuation command generated by the system and method of the present invention is used to actuate a countermeasure system which may be based either on the aircraft under attack or at another location. In order to actuate aircraft-based countermeasures, the system of the present invention preferably includes a transmitter 24 configured for transmitting the actuation command to the aircraft 26 towards which the missile 28 is navigating. The aircraft then activates one or more countermeasures, represented here schematically by flares 30.

The countermeasures themselves may be any countermeasures or combinations thereof known to be effective against one or more type of threat. Options include, but are not limited to, flares and other infrared emitting decoys, radar chaff, radar decoys, radar jammers and DIRCM.

According to a further option, one or more countermeasure system may be deployed on a ground mounted, floating or airborne platform to provide protection to aircraft in the region independent of whether the individual aircraft are fitted with countermeasure systems.

Figure 2:
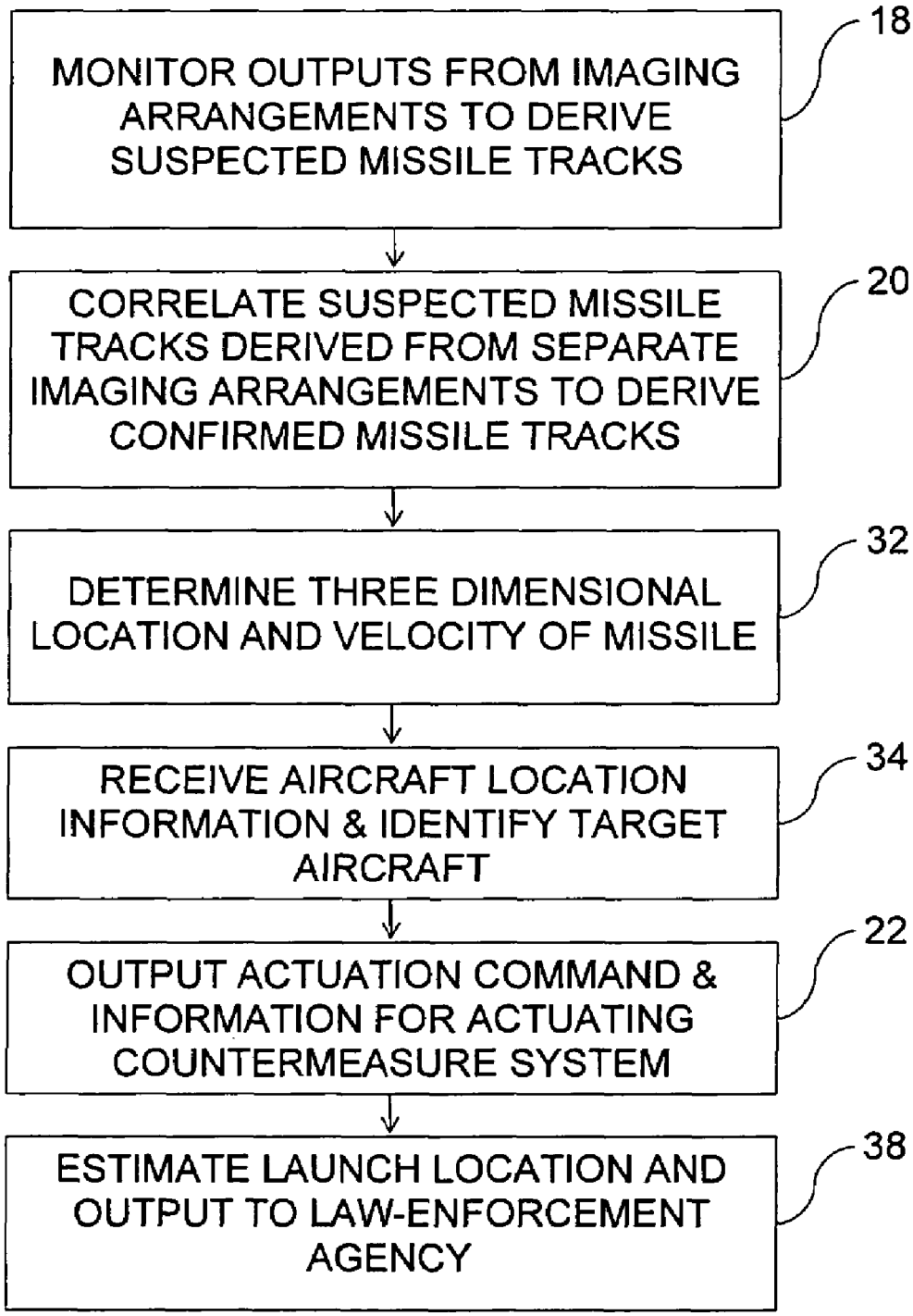
FIG. 2 is a flow diagram illustrating the operation of the system of FIG. 1 and the corresponding method of the present invention.

Turning now in more detail to the operation of the present invention as illustrated in FIG. 2, step 18 may readily be implemented using a standard detection and tracking modules common in the field of infrared search-and-track (IRST) systems. The correlation of step 20 preferably starts as soon as a new track is initialized, immediately searching for a compatible corresponding track detected in one or more imaging arrangements with overlapping fields of view. As the tracks develop, the parallax between the imaging arrangements ensures that any mismatching of suspected tracks will typically result in implied spatial motion which is either physically impossible or at least incompatible with the behavior of a surface-to-air missile. For this reason, the correlation of tracks between two spaced-apart sensors is a highly reliable technique for reducing the FAR of the system. Step 20 preferably also distinguishes between threatening missiles and other real tracks of non-threatening airborne objects such as the aircraft to be protected themselves. Rejection of tracks relating to legitimate airborne objects may be performed at various stages and using various techniques, as will be clear to one ordinarily skilled in the art. By way of non-limiting examples, aircraft and other large objects may be rejected at the initial tracking stage (step 18) on the basis of their distinctive thermal signatures, they may be rejected in step 20 on the basis of highly horizontal direction of flight and relatively low speed, or they may be disregarded on the basis of specific air-tracking information provided to the system from an air-traffic control system or the like.

It is a particularly preferred feature of certain implementations of the present invention that the processing system also determines position and motion data in three dimensions for each missile corresponding to a confirmed missile track. This information, illustrated in FIG. 2 as step 32, is most preferably integrated with the track correlation step 20. Specifically, each track effectively defines a sequence of direction-to-target vectors as viewed by the corresponding imaging arrangement. By associating simultaneous pairs of direction-to-target vectors generated by two spaced-apart imaging arrangements in known locations, a sequence of precise positions of the tracked target in three-dimensional space can be derived by triangulation. The current position of the end of the track gives the current position of the target missile, and the sequence of prior positions is indicative both of the velocity and acceleration of the target. This information is preferably used in verification that the tracked object matches the minimal characteristics which are expected of a missile. In some cases, the speed and acceleration profile may provide additional information as to the class of missiles to which the threat belongs, and this information may then be used in decision-making processing as to which of a number of available types of countermeasures should be employed.

Determination of the position, speed and/or acceleration of the missile may also be of importance for numerous additional reasons. Firstly, the position, speed and acceleration parameters are vital for determining towards which of a plurality of aircraft in the region a missile is currently navigating (step 34). For this purpose, the system preferably also receives information indicative of at least a current position of each aircraft within the airspace of the predefined geographical region (Although the system may itself optically track the positions of the aircraft as mentioned earlier, additional input information is typically required to uniquely identify each aircraft for aircraft-specific radio communication or the like.) Secondly, the motion parameters are preferably used in the countermeasures deployment of step 22. In the case of directional countermeasures such as DIRCM, this information is relayed to the countermeasure system as part of the actuation command in order to provide an initial bearing for identifying and locking on to the target missile. Even for non-directional countermeasures such as flares and chaff, the motion parameters may be used to predict an estimated intercept time of the missile with its intended target so that the countermeasures can be deployed at the optimal time prior to estimated intercept for maximum decoy effectiveness. Finally, knowledge of the position, velocity and acceleration of the missile along its path allows backwards extrapolation to estimate a geographical launch location (launcher 36 in FIG. 1) from which each of the confirmed missile tracks originated for output to a law enforcement agency (step 38).

Figure 5:
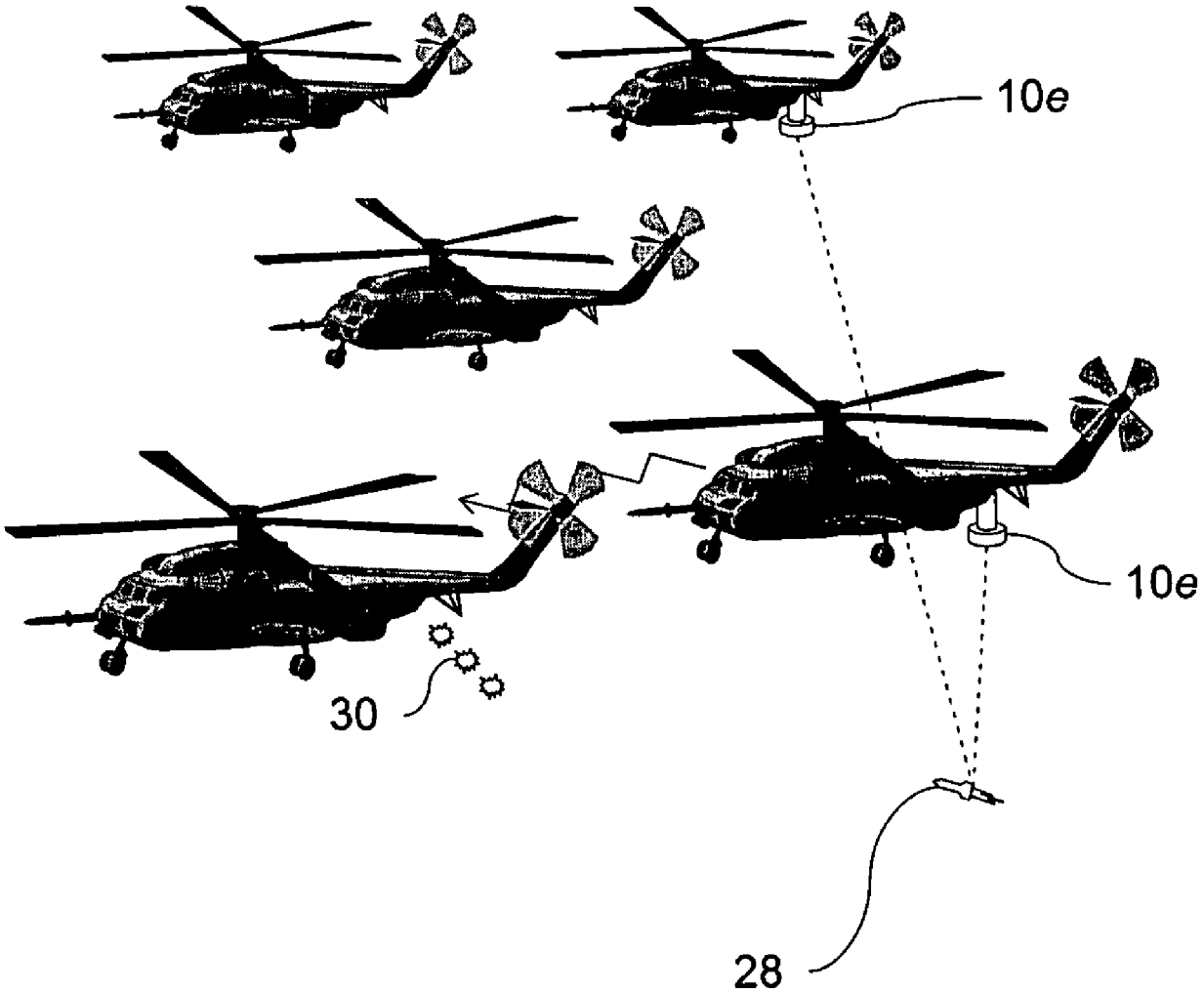
FIG. 5 is a schematic illustration of an alternative airborne implementation of the present invention.

Turning finally to FIG. 5, although illustrated above with reference to a predefined geographical region, it should be noted that the present invention may also be used to great advantage where a plurality of aircraft are airborne simultaneously in sufficient proximity to generate overlap in coverage of anti-aircraft missile detection systems. This may be relevant to civilian applications, for example around busy airports, but is of particular relevance to military applications where multiple aircraft often fly together for part or all of a joint mission.

One such example is illustrated schematically in FIG. 5 which shows five aircraft, in this case helicopters, flying together. At least two of the helicopters are fitted with optical imaging arrangements 10*e* as already described with reference to FIG. 1. Clearly, three or more aircraft may carry such systems. Since the imaging arrangements are carried by aircraft traveling with the group, they give coverage at all times of the airspace surrounding the group, at least below the aircraft and preferably approximating to the lower hemisphere, and optionally expanded also to cover regions above the aircraft. As before, it is no necessary for all of the aircraft in the group to be equipped with imaging arrangements since the two or more imaging arrangements used provide detection coverage for the entire group. The countermeasures 30 are typically still provided on each aircraft individually. The system is preferably configured to detect and counter both surface-to-air and air-to-air missiles.

The remaining components of the system of the present invention such as the processing system (not shown) may be implemented onboard one of the aircraft, distributed between the aircraft, or deployed at a remote location with which the aircraft have wireless communication.

It will be appreciated that this implementation also provides some or all of the advantages of the ground-based systems described above. Specifically, by employing multiple spaced-apart imaging arrangements, the FAR is hugely diminished compared to the individual performance of each detector arrangement alone. Furthermore, the determination of the missile position and motion parameters is greatly improved by triangulation between the sensors. Finally, deployment of the imaging arrangements on only a subset of the aircraft provides very considerable cost savings.

It will be appreciated that the above descriptions are intended only to serve as examples, and that many other embodiments are possible within the scope of the present invention as defined in the appended claims.

What is claimed is:

1. A system for identifying missile threats against aircraft within a region of interest and activating a countermeasure system, the system comprising:

(a) a plurality of spaced-apart optical imaging arrangements deployed relative to the region of interest such that at least part of the airspace over substantially the entirety of the region of interest falls within the field of view of at least two of said optical imaging arrangements; and (b) a processing system including at least one processor, said processing system being associated with said plurality of optical imaging arrangements and configured to:

(i) process outputs from each of said optical imaging arrangements to derive suspected missile tracks;

(ii) correlate suspected missile tracks derived from separate ones of said optical imaging arrangements to derive a confirmed missile track only when correlation is found between suspected missile tracks derived from at least two of said optical imaging arrangements; and (iii) output an actuation command in response to said confirmed missile track for actuating a countermeasure system.

2. The system of claim 1, wherein said processing system is further configured to determine a current position in three dimensions of a missile corresponding to each confirmed missile track.

3. The system of claim 2, wherein said processing system is further configured to determine a velocity vector in three dimensions of a missile corresponding to each confirmed missile track.

4. The system of claim 2, wherein said processing system is further configured to determine an acceleration of a missile corresponding to each confirmed missile track.

5. The system of claim 1, wherein said processing system is further configured to:

(a) receive information indicative of at least a current position of each aircraft within the airspace of the region of interest; and (b) determine towards which of said aircraft a missile corresponding to each confirmed missile track is navigating.

6. The system of claim 5, further comprising a transmitter configured for transmitting said actuation command to said aircraft towards which the missile is navigating for activation of an aircraft-based countermeasure system.

7. The system of claim 1, wherein said processing system is further configured to estimate a geographical launch location from which each of said confirmed missile tracks originated.

8. The system of claim 1, wherein at least one of said optical imaging arrangements is implemented as a panoramic arrangement including a plurality of optical imaging arrays deployed to provide an effective field of view substantially spanning 360 degrees.

9. The system of claim 1, wherein the region of interest is a predefined geographical region.

10. The system of claim 9, wherein said processing system is further configured to:

(a) receive additional suspected missile track data relayed from a missile detection system mounted on at least one aircraft currently airborne near the airport; and (b) correlate said additional suspected missile track data with at least one of: suspected missile tracks derived from one of said optical imaging arrangements; and confirmed missile tracks derived by said processing system.

11. The system of claim 9, wherein said plurality of optical imaging arrangements are deployed in substantially stationary locations relative to the predefined geographical region.

12. The system of claim 9, wherein two of said plurality of optical imaging arrangements are spaced apart by at least about 1 kilometer.

13. The system of claim 9, wherein at least one of said optical imaging arrangements is deployed on a floating platform.

14. The system of claim 9, wherein the predefined geographic region encompasses a circular area of radius at least 15 kilometers around an airport.

15. The system of claim 14, wherein the predefined geographic region further encompasses at least one converging strip terminating at a distance of at least 40 kilometers from the airport.

16. The system of claim 1, wherein said plurality of spaced-apart optical imaging arrangements are mounted on a plurality of aircraft, and wherein the region of interest is a region of airspace surrounding said plurality of aircraft.

17. The system of claim 16, wherein said plurality of spaced-apart optical imaging arrangements are mounted on a subset of a group of aircraft flying together.

18. A method for identifying missile threats against aircraft within a region of interest and activating a countermeasure system, the system comprising:

(a) deploying a plurality of spaced-apart optical imaging arrangements deployed relative to the region of interest such that at least part of the airspace over substantially the entirety of the region of interest falls within the field of view of at least two of said optical imaging arrangements;

(b) monitoring outputs from each of said optical imaging arrangements to derive suspected missile tracks;

(c) correlating suspected missile tracks derived from separate ones of said optical imaging arrangements to derive a confirmed missile track only when correlation is found between suspected missile tracks derived from at least two of said optical imaging arrangements; and (d) outputting an actuation command on derivation of a confirmed missile track for actuating a countermeasure system.

19. The method of claim 18, further comprising determining a current position in three dimensions of a missile corresponding to each confirmed missile track.

20. The method of claim 19, further comprising determining a velocity vector in three dimensions of a missile corresponding to each confirmed missile track.

21. The method of claim 19, further comprising determining an acceleration of a missile corresponding to each confirmed missile track.

22. The method of claim 18, further comprising:

(a) receiving information indicative of at least a current position of each aircraft within the airspace of the region of interest; and (b) determining towards which of said aircraft a missile corresponding to each confirmed missile track is navigating.

23. The method of claim 22, further comprising transmitting said actuation command to said aircraft towards which the missile is navigating for activation of an aircraft-based countermeasure system.

24. The method of claim 18, further comprising estimating a geographical launch location from which each of said confirmed missile tracks originated.

25. The method of claim 18, wherein at least one of said optical imaging arrangements is implemented as a panoramic arrangement including a plurality of optical imaging arrays deployed to provide an effective field of view substantially spanning 360 degrees.

26. The method of claim 18, wherein the region of interest is a predefined geographical region.

27. The method of claim 26, further comprising:

(a) receiving additional suspected missile track data relayed from a missile detection system mounted on at least one aircraft currently airborne near the predefined geographical region; and (b) correlating said additional suspected missile track data with at least one of: suspected missile tracks derived from one of said optical imaging arrangements; and confirmed missile tracks derived by said processing system.

28. The method of claim 26, wherein said plurality of optical imaging arrangements are deployed in substantially stationary locations relative to the predefined geographical region.

29. The method of claim 26, wherein two of said plurality of optical imaging arrangements are spaced apart by at least about 1 kilometer.

30. The method of claim 26, wherein at least one of said optical imaging arrangements is deployed on a floating platform.

31. The method of claim 26, wherein the predefined geographic region encompasses a circular area of radius at least 15 kilometers around an airport.

32. The method of claim 31, wherein the predefined geographic region further encompasses at least one converging strip terminating at a distance of at least 40 kilometers from the airport.

33. The method of claim 31, wherein said plurality of spaced-apart optical imaging arrangements are mounted on a plurality of aircraft, and wherein the region of interest is a region of airspace surrounding said plurality of aircraft.

34. The method of claim 33, wherein said plurality of spaced-apart optical imaging arrangements are mounted on a subset of a group of aircraft flying together.

* * * * *